US005448326A

United States Patent [19]

Pummell et al.

[11] Patent Number: 5,448,326

[45] Date of Patent: Sep. 5, 1995

[54] PHOTOGRAPHIC PROCESSING APPARATUS

[75] Inventors: Leslie J. H. Pummell, Rickmanswork; Paul C. Ward, Oxhey; Stephen J. Kingdon, St. Albans; James A. Oldfield, Bucks, all of England

[73] Assignee: Eastman Kodak Company, Rochester, N.Y.

[21] Appl. No.: 36,606

[22] Filed: Mar. 24, 1993

[30] Foreign Application Priority Data

Mar. 24, 1992 [GB] United Kingdom ..... 9206391

[51] Int. Cl.[6] ..... G03D 3/08

[52] U.S. Cl. ..... 354/319; 354/321

[58] Field of Search ..... 354/298, 317–324,339, 354/340; 156/506, 502, 504, 505, 353; 83/364; 242/538; 226/91, 92

[56] References Cited

U.S. PATENT DOCUMENTS

| | | | |
|---|---|---|---|
| 688,115 | 12/1901 | Pollack et al. | 354/322 |
| 2,401,185 | 5/1946 | Pratt et al. . | |
| 3,195,438 | 7/1965 | Woodcock | 354/321 X |
| 3,336,853 | 8/1967 | Friedel | 354/321 X |
| 3,345,928 | 10/1967 | Krehbiel | 354/321 |
| 3,523,498 | 8/1970 | Phleps et al. | 354/321 |
| 3,593,640 | 7/1971 | Gall | 354/325 X |
| 3,656,676 | 4/1972 | Hope et al. | 226/92 |
| 3,662,665 | 5/1972 | Meeussen et al. | 354/321 X |
| 3,806,574 | 4/1974 | Arvidson, Jr. | 242/538 X |
| 3,952,610 | 4/1976 | Hope et al. | 74/421 |
| 4,045,809 | 8/1977 | Landers | 354/322 |
| 4,046,614 | 9/1977 | Zahn | 156/506 X |
| 4,079,635 | 3/1978 | Hope et al. | 74/421 |
| 4,099,194 | 7/1978 | Kummerl | 354/321 |
| 4,118,998 | 10/1978 | Hope et al. | 74/421 |
| 4,140,383 | 2/1979 | Schmidt | 354/316 |
| 4,185,912 | 1/1980 | Schwartz | 355/28 |
| 4,230,404 | 10/1980 | Huss | 354/321 |
| 4,239,367 | 12/1980 | Hope et al. | 354/319 |
| 4,248,515 | 2/1981 | Fernandez et al. | 354/321 |
| 4,248,516 | 2/1981 | Grooters | 354/321 |
| 4,279,495 | 7/1981 | Fukushima et al. | 354/321 |
| 4,292,115 | 9/1981 | Jones et al. | 354/297 X |
| 4,312,470 | 1/1982 | Hope et al. | 226/183 |
| 4,326,791 | 4/1982 | Beer et al. | 354/321 |
| 4,411,725 | 10/1983 | Siegel et al. | 156/353 |
| 4,466,316 | 8/1984 | Kobayashi et al. | 83/364 X |
| 4,543,151 | 9/1985 | Aldo | 156/502 |
| 4,894,675 | 1/1990 | Würfe et al. | 354/310 X |
| 5,229,802 | 7/1993 | Shiota et al. | 354/354 X |

FOREIGN PATENT DOCUMENTS

| | | | |
|---|---|---|---|
| 2819745 | 11/1979 | Germany | 354/319 |
| 1381916 | 10/1975 | United Kingdom . | |
| 1469000 | 3/1977 | United Kingdom . | |

*Primary Examiner*—D. Rutledge
*Attorney, Agent, or Firm*—Frank Pincelli

[57] ABSTRACT

In some types of processing apparatus, there is a minimum length of film strip which can be processed. To overcome this problem, several film strips may be spliced together to provide the desired length and/or a leader attached to the leading edge of the film strip to guide it through the apparatus for processing. Described herein is a loading device which removes the need for splicing and attachment of leaders to the film strip prior to processing. The device allows a film to be automatically removed from its cassette and loaded into processing apparatus and comprises a housing in which a cassette unloading station (12), a film delivery station (14) connected to processing apparatus, a storage station (16), a film length measuring station (18), a direct film loading station (22), and a cutting station (24) are arranged. Pairs of transport rollers (26, 28) and (30, 32) are provided to transport the film through the device.

6 Claims, 1 Drawing Sheet

PHOTOGRAPHIC PROCESSING APPARATUS

FIELD OF THE INVENTION

This invention relates to photographic processing apparatus and is more particularly concerned with a film unloading device for use with such apparatus.

BACKGROUND INFORMATION

Most photographic film now used is 35 mm format film. Cameras have been developed to allow film of this format to be easily loaded by placing the film cassette, in which the film is stored, into an opening in the back of the camera and then shutting the back of the camera. As a free end or tongue of the film extends externally to the film cassette, this is used to automatically advance the film in the camera for picture taking. Once all the pictures have been taken, the film is rewound into the film cassette for removal from the camera for processing. In order for this to work, the free end or tongue of the film must extend externally to the cassette so that it can be pulled on to the take-up spool in the camera as the film is first loaded.

Photographic film tends to be processed in a single strip once the film has been removed from its cassette. Strips of negative film are processed by transporting them, either as a single individual strip or as a continuous length comprising two or more strips of shorter lengths, through a series of processing solutions in various tanks in the processing apparatus.

In known processing apparatus, the film strip is pulled through tanks containing the processing solutions either by a leader which is attached to the leading edge of the film strip, or by moving a rack or spiral containing the film strip from tank to tank. Individual film strips may be pre-spliced into a long reel with a leader card at the front end, clipped to a rack, or fed into a spiral.

Where the film strip is attached to a leader, it is unloaded from the cassette and attached to the leader in a manual operation. The leader is then fed into the processing apparatus so that the film can be processed as it is transported through the apparatus.

Operations of splicing the film strips together or attaching the leader to the strip need to be carried out in darkroom conditions due to the sensitive nature of the film.

GB-A-1 469 000 discloses a film handling arrangement which allows the film to be unloaded from its cassette and loaded into the processing apparatus. The film handling arrangement includes a take-up reel to which the free end of the film is connected. The film is withdrawn from the cassette into the take-up reel and is cut from the spool to allow the film to be contained within the take-up reel, the cutting mechanism being actuated by tension applied to the film as it is withdrawn from the cassette.

The take-up reel described in GB-A-1 469 000 comprises a barrel for supporting the film and allowing it to be rotated in a reservoir of processing chemicals to develop the latent image stored on the film.

However, in some processing apparatus, there is a minimum length of film strip which can be processed. As a result, several film strips need to be spliced together prior to processing. This may be time-consuming as each strip will need to be measured to ensure that the minimum processing length is present in the spliced strip prior to processing.

It is therefore an object of the present invention to provide a loading device for a photographic processing apparatus in which the film strip is automatically unloaded from its cassette, its length checked, and then fed into the processor if the film strip exceeds the minimum length under the control of the process computer.

SUMMARY OF THE INVENTION

According to one aspect of the present invention, there is provided a loading device for photographic processing apparatus comprising:

film cassette support means for supporting a film cassette as its film is withdrawn;

storage means into which the film is transported after withdrawal from its cassette;

guillotine means for cutting the film away from its supporting spool within the cassette;

film length measuring means for measuring the length of the film as it is withdrawn from the cassette; and control means for controlling the film during its withdrawal from its cassette and its subsequent transferral to the processing apparatus.

By this arrangement, an exposed film strip can be unloaded from its cassette, have its length measured and then passed into the processing apparatus without the need for leaders or splicing.

Advantageously, the device further includes film path defining means for defining a first film path which extends between the film cassette support means and the storage means, and a second film path which extends between the storage means and the processing apparatus.

Preferably, at least a portion of the first film path is coincident with the second film path.

The guillotine means may operate to traverse the first film path substantially adjacent the film cassette support means thereby cutting the film.

The control means may include drive means for driving the film through the device, actuation means for operating the guillotine means, and comparison means for comparing the value relating to the measured film length from the film length measuring means with a predetermined value.

BRIEF DESCRIPTION OF THE DRAWINGS

For a better understanding of the present invention, reference will now be made, by way of example only, to the accompanying drawing, the single FIGURE of which illustrates a schematic side elevation of a loading device constructed in accordance with the present invention.

DESCRIPTION OF THE PREFERRED EMBODIMENT

Figure 1:
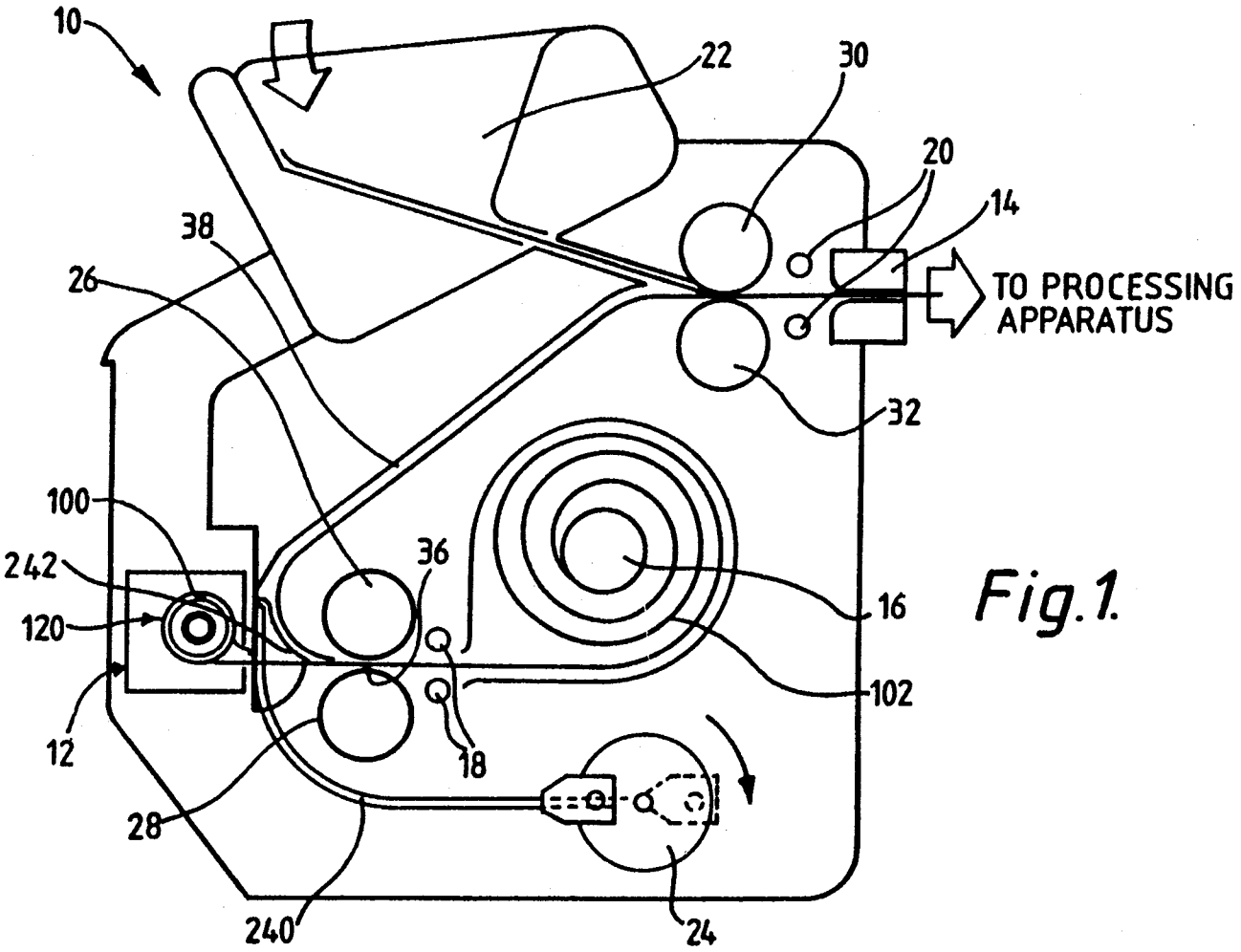

The device 10 shown in the FIGURE comprises a cassette unloading station 12, a film delivery station 14 connected to processing apparatus (not shown), a storage station 16, a film length checking station 18, a film position checking station 20, a direct film loading station 22, and a cutting station 24. Pairs of transport rollers 26, 28 and 30, 32 are provided to transport the film through the device 10. These rollers are driven by one or more motors (not shown).

At the cassette unloading station 12, a film cassette 100 is positioned in a cassette-shaped aperture 120 with a free end of the film, otherwise called the film leader or the tongue, extending through the cassette wall. The length of the film leader or tongue is determined by a guide (not shown) which is positioned on the outside of the device 10. A slot (not shown) is arranged in the casing of the device 10 so that the film leader can be introduced into the device 10 and positioned between transport roller pair 26, 28, which are initially spaced apart.

Once the cassette 100 is loaded into the cassette unloading station 12 and the film leader is positioned between roller pair 26, 28, the device 10 can be operated and unloading of the film from its cassette can take place.

Roller 26 is a pinch roller which is movable between a first position in which it is not in contact with roller 28, and a second position in which it is in contact with roller 28. The roller 26 is moved between these two positions by a first motor (not shown).

Roller 28 is a drive roller and is driven by a second motor (also not shown). A clutch arrangement (not shown) is associated with roller 28 and the second motor, the clutch slipping when all the film 102 has been unwound from its cassette 100 to prevent the motor stalling. Operation of the cutting station 24 is then initiated.

Once the cassette 100 is correctly positioned as discussed above, ie with the film leader positioned between rollers 26, 28, the first motor operates to move roller 26 against roller 28. The second motor then operates to drive roller 28 and the film 102 is pulled out of its cassette 100 and into the storage station 16, along a first film path 36 which extends between the cassette unloading station 12 and the storage station 16, by roller 28 acting against roller 26. The slot in the casing of the device 10, as mentioned above, is located to coincide with at least the portion of the first film path 36 with extends between the cassette unloading station 12 and the transport rollers 26, 28 are arranged along this path 36.

As the film is unwound from its cassette 100, it is transported along path 36 and into storage station 16, its length is checked by the film length checking station 18. This station comprises a pair of spaced apart sensors (not shown in detail) to count or detect the presence of perforations or sprocket holes in the film 102.

Once all the film 102 has been unwound from the cassette 100, the second motor is inactived and drive to the roller 28 is shut down. The cutting station 24 then comes into operation. This station comprises a guillotine blade 240 driven by a third motor and associated gearbox (not shown) to move in an upwardly direction from the base of the device 10. The blade 240 is rotated through an angle of 180° by the third motor, and in so doing, cuts through the film 102 at a position adjacent the film unloading station 12 to release it from the spool (not shown) to which it is attached inside the cassette 100. The guillotine blade 240 carries a guide 242 adjacent its cutting edge as shown.

Once the film has been cut, the cassette 100 can be discarded from the unloading station 12 and recycled as desired.

It is to be noted that film 102 is not all wound into the storage station 16 as roller 28 is inactivated prior to operation of the cutting station 24. This means that there is a portion of the film 102 adjacent the newly severed leading edge which is trapped between roller pair 26, 28.

Provided the length of the film exceeds a minimum predetermined value as measured by the film length checking station 18, the second motor is activated once more in the opposite direction so that roller 28, in conjunction with pinch roller 26, will then transport the film 102, with its newly severed end leading, along second film path 38 towards the other pair of transport rollers 30, 32.

The second film path 38 includes the first film path 36, but the film 102 is driven along it in the opposite direction. The guide 242 attached to the guillotine blade 240 acts to direct the film 102 from the first film path 36 upwardly into the upper portion of the second film path 38.

Transport roller pair 30, 32 comprises a pinch roller 30 and a drive roller 32 in similar fashion to transport roller pair 26, 28. As the film 102 is driven towards roller pair 30, 32, the pinch roller 30 is spaced away from the drive roller 32 and the newly severed leading edge of the film leader can pass therebetween up to the film position checking station 20. Once the presence of the film 102 has been sensed at the checking station 20, the second motor is inactivated and a fourth motor operates to bring the pinch roller 30 into contact with drive roller 32.

The first motor is then operated to lift roller 26 off roller 28 so that the film 102 can be controlled from the roller pair 30, 32.

When the control system of the processing apparatus asks for the film 102, drive is provided to drive roller 32 by a fifth motor (not shown). The film 102 is then driven to the film delivery station 14 for entry into the processing apparatus.

Once the leading edge of the film 102 has been engaged by the drive system of the processing apparatus, the fourth motor operates to lift pinch roller 30 off drive roller 32 and allows the movement of the film to be controlled by the processing apparatus.

Once all the film has been delivered to the processing apparatus, drive to drive roller 30 is stopped, and the guillotine blade 240 is then returned to its rest position in the device 10 by rotating it through a further 180° under the control of the third motor.

After passing between rollers 30, 32, the film length may be checked again at the film position checking station 20 prior to the film being driven through the film delivery station 14 and into the processing apparatus.

The roller pair 30, 32 and the film position checking station 20 may have an additional function, namely, that of transporting and checking the length of film strips which are introduced manually into the direct loading station 22.

It may be desirable to incorporate an alarm which is activated by the film position checking station 20 to indicate to the operator that the film is not of the appropriate length.

It may also be desirable to arrange for a transfer zone between the film delivery station 14 and the processing apparatus so that short lengths of film which have been inadvertently introduced into the loading device 10 via the direct loading station 22 can be removed prior to reaching the processing apparatus.

The loading device according to the present invention has the following advantages:

a) less time is spent loading the processing apparatus as the film cassette can be loaded into the device under normal lighting conditions;

b) no clips or adhesive strips are required and therefore there is no chance of jams being caused in the processing apparatus due to these items coming undone once inside the apparatus;

c) the length of the film to be processed is automatically checked, and films having a length less than a predetermined value can be retained in the storage station 16 once the film has been cut from its spool for subsequent removal and handling;

d) a newly severed edge is provided at the trailing edge as the film is unwound—this edge then becomes the leading edge as far as the processing apparatus is concerned and provides, a good lead into the apparatus;

e) automatic methods of detecting perforation damage could easily be added.

Apart from use in a loading device for any process which requires film to be removed from a cassette for further processing, the present invention can be applied to any film or paper held in a reel inside a cassette-like container.

We claim:

1. A loading device for photographic processing apparatus comprising:

film cassette support means for supporting a film cassette as its film is withdrawn;

storage means into which the film is transported for storing the film after withdrawal from its cassette;

guillotine means for cutting the film away from its supporting spool within the cassette;

film length measuring means for measuring the length of the film as it is withdrawn from the cassette;

control means for controlling the film during its withdrawal from its cassette to the storage means and its subsequent transferal from the storage means to the processing apparatus; and film path defining means for defining a first film path which extends between the film cassette support means and the storage means, and a second film path which extends between the storage means and the processing apparatus, at least a portion of the first film path is coincident with the second film path, said first and second film path being positioned such that when the film is moved from the storage means, the trailing end of the film will be the end which is first delivered to the processing apparatus.

2. A device according to claim 1, wherein the film measuring means is positioned on at least the first film path.

3. A device according to claim 1, wherein the guillotine means operates to traverse the first film path substantially adjacent the film cassette support means thereby cutting the film.

4. A device according to claim 1, wherein the control means includes drive means for driving the film through the device, actuation means for operating the guillotine means, and comparison means for comparing the value relating to the measured film length from the film length measuring means with a predetermined value.

5. A device according to claim 1, further including a manual film loading station in which film strip lengths can be checked for length and then loaded into the processing apparatus.

6. A loading device for photographic processing apparatus comprising:

film cassette support means for supporting a film cassette as its film is withdrawn;

storage means into which the film is transported for storing the film after withdrawal from its cassette;

guillotine means for cutting the film away from its supporting spool within the cassette;

film length measuring means for measuring the length of the film as it is withdrawn from the cassette;

control means for controlling the film during its withdrawal from its cassette to the storage means and its subsequent transferal from the storage means to the processing apparatus; and film path defining means for defining a first film path which extends between the film cassette support means and the storage means, and a second film path which extends between the storage means and the processing apparatus, the guillotine means operates to transverse the first film path substantially adjacent the film cassette support means by cutting the film, said first and second film path being positioned such that when the film is moved from the storage means, the trailing end of the film will be the end which is first delivered to the processing apparatus.

* * * * *